US005347981A

United States Patent [19]

Southern et al.

[11] Patent Number: 5,347,981

[45] Date of Patent: Sep. 20, 1994

[54] PILOT PRESSURE SWITCH AND METHOD FOR CONTROLLING THE OPERATION OF A FURNACE

[75] Inventors: Malcolm Southern; Walter Wolenski, both of Houston, Tex.

[73] Assignee: Goodman Manufacturing Company, L.P., Houston, Tex.

[21] Appl. No.: 117,308

[22] Filed: Sep. 7, 1993

[51] Int. Cl.[5] ..... F24H 3/00

[52] U.S. Cl. ..... 126/116 A; 431/12; 431/20; 431/90; 126/110 R

[58] Field of Search ..... 126/116 A, 116 R, 110 R, 126/99 R, 99 C, 110 A; 431/90, 26, 29, 30, 31, 12, 20, 61

[56] References Cited

U.S. PATENT DOCUMENTS

| | | | |
|---|---|---|---|
| 2,549,633 | 4/1951 | Ottmar | 431/29 |
| 3,905,747 | 9/1975 | Branson | 431/61 |
| 4,204,833 | 5/1980 | Kmetz | 431/20 |
| 4,533,315 | 8/1985 | Nelson | 431/20 |
| 4,729,207 | 3/1988 | Dempsey et al. | 126/112 |
| 4,974,579 | 12/1990 | Shellenberger et al. | 126/110 R |
| 5,060,722 | 10/1991 | Zdenek et al. | 165/170 |

*Primary Examiner*—James C. Yeung
*Attorney, Agent, or Firm*—Ben D. Tobor

[57] ABSTRACT

A pilot pressure switch for a furnace detects the fluid pressure within the pilot line for a pilot flame, and upon the fluid pressure in the pilot line exceeding a predetermined value, an electrical signal from a thermostat may be passed to a furnace blower control to operate the furnace main blower and furnace vent blower.

9 Claims, 1 Drawing Sheet

PILOT PRESSURE SWITCH AND METHOD FOR CONTROLLING THE OPERATION OF A FURNACE

BACKGROUND OF THE INVENTION

1. Field of the Invention

The invention relates to a pilot pressure switch for a furnace and a method for controlling the operation of a furnace, specifically to prevent the operation of the furnace when a pilot flame, which is intended to be continuously burning, is not burning as desired.

2. Description of the Prior Art

Many gas furnaces today utilize a continuously burning pilot flame as a source of ignition for the fuel which is burned in the furnace to provide heated air to a space, or room, to be heated. Such furnaces also typically utilize a solid state blower control device to control the operation of the main blower and a vent blower of the furnace. Typically, if the thermostat, disposed in the space, or room, to be heated, indicates that heat should be supplied to the space, or room, an electrical signal, or control voltage, is passed through the circuitry of the furnace, from the thermostat to the solid state blower control. Typically, the blower control first causes the furnace vent blower to operate. Subsequent to the furnace vent blower operating, and a conventional checking of the furnace safety controls, the burners of the furnace are ignited by the continuously burning pilot flame, and subsequently the furnace blower begins to operate to blow air through the furnace, and over the heat exchangers of the furnace, in a conventional manner.

A disadvantage associated with such prior art furnaces is that if the pilot flame, which is intended to be continuously burning, is not lit, or burning, the solid state blower control will still operate to initiate operation of the furnace vent blower and the furnace main blower in the manner previously described, even though there is no source of ignition for the gas to be burned in the burners of the furnace. For example, the pilot flame, which is intended to continuously burn, may not be burning because either the gas supply to the furnace has been interrupted, or the conventional pilot thermocouple is inoperable. It would be desirable to ensure that the furnace vent blower and main furnace blower will not operate if the pilot flame is not lit, or burning.

Accordingly, prior to the development of the present invention, there has been no pilot pressure switch for a furnace, or method for controlling the operation of a furnace, which prevents the operation of the furnace vent blower and furnace main blower, should the pilot flame not be lit, or burning. Therefore, the art has sought a pilot pressure switch and a method for controlling the operation of a furnace, which prevents the operation of the furnace vent blower and furnace main blower, if a pilot flame is not lit, or burning.

SUMMARY OF THE INVENTION

In accordance with the invention, the foregoing advantage has been achieved through the present pilot pressure switch, for a furnace having a continuously burning pilot flame in fluid communication with a furnace gas valve by a pilot line disposed between the pilot flame and the gas valve, the furnace also including a thermostat and a blower control with at least one wire disposed between the thermostat and the blower control. This aspect of the present invention includes a means for detecting the fluid pressure within the pilot line, the fluid pressure detecting means being disposed in fluid communication with the pilot line; and a means for controlling the passage of an electrical signal through the at least one wire in response to the fluid pressure detected in the pilot line, whereby if the fluid pressure detected in the pilot line exceeds a predetermined fluid pressure, the electrical signal from the thermostat passes through the at least one wire to the blower control.

An additional feature of the present invention is that the means for detecting the fluid pressure may be a diaphragm switch. An additional feature of the present is that the means for controlling the passage of the electrical signal may be a single pole, single throw electrical switch which is operatively associated with the means for detecting the fluid pressure.

The foregoing advantage is also achieved through another aspect of the present invention which is a method for controlling the operation of a furnace having a continuously burning pilot flame in fluid communication with a furnace gas valve by a pilot line disposed between the pilot flame and the gas valve, the furnace also including a thermostat and a blower control with at least one wire disposed between the thermostat and the blower control. This method may include the steps of: detecting the fluid pressure within the pilot line; controlling the passage of an electrical signal through the at least one wire in response to the fluid pressure in the pilot line; and permitting the electrical signal to pass through the at least one wire from the thermostat to the blower control when the fluid pressure detected in the pilot line exceeds a predetermined fluid pressure.

A feature of this aspect of the present invention may include the step of not permitting the electrical signal to pass through the at least one wire from the thermostat to the blower control when the fluid pressure detected in the pilot line is less than a predetermined fluid pressure. Another feature of the present invention may include the step of utilizing a diaphragm switch disposed in fluid communication with the pilot line to detect the fluid pressure in the pilot line. A further feature of the present invention may include the step of utilizing a single pole, single throw electrical switch to control the passage of the electrical signal through the at least one wire. Another feature of the present invention may include the step of closing the single pole, single throw electrical switch to permit the electrical signal to pass through the at least one wire, when the fluid pressure detected in the pilot line exceeds a predetermined fluid pressure.

The pilot pressure switch and method for controlling the operation of a furnace of the present invention, when compared with previously proposed methods for controlling the operation of a furnace, has the advantage of preventing the operation of the furance vent blower and furnace main blower, if a pilot flame is not lit, or burning.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
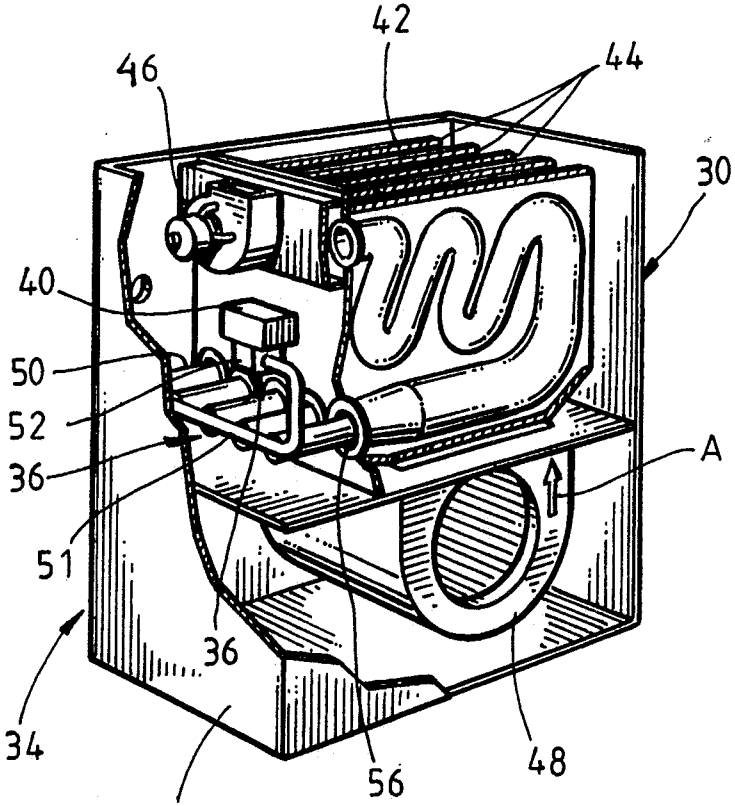
FIG. 1 is a perspective partial cross-sectional view of a conventional furnace which can be provided with the pilot pressure switch of the present invention and may be controlled with the method for controlling the operation of a furnace in accordance with the present invention.

With reference to FIG. 1, a conventional gas furnace 30 is shown to include: a cabinet 32; a combustion system 34 including a burner assembly 36, a gas valve assembly 38, and a blower control 40; a heat exchanger assembly 42 including a plurality of heat exchangers 44; furnace vent blower 46; and a main furnace blower 48. The main furnace air blower 48 blows air in the direction indicated by arrow A, which air passes over the heat exchangers 44, as is conventional in the art. Although described as an upflow furnace, the pilot pressure switch 100 of the present invention, as will be hereinafter described in greater detail, may also be used with downflow or horizontally disposed furnaces 30.

Figure 2:
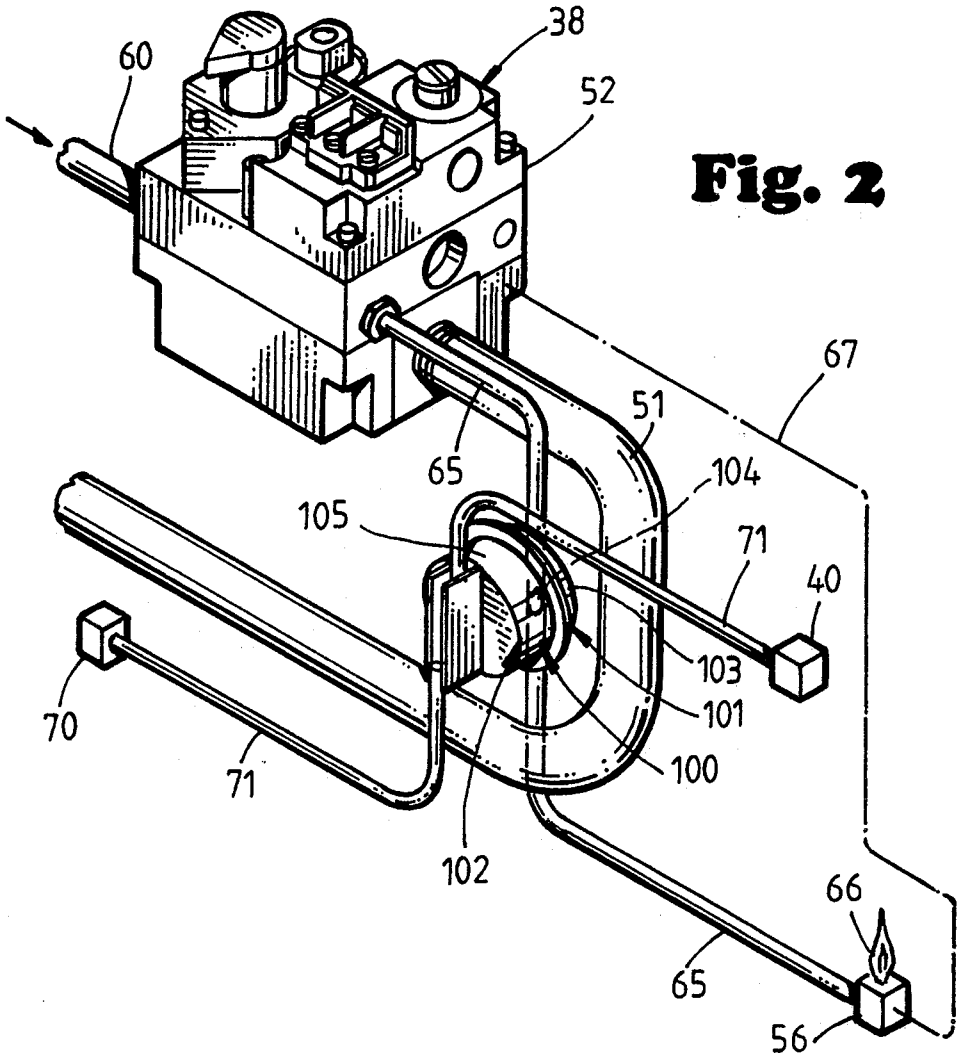
FIG. 2 is a perspective view of a conventional gas valve provided with the pilot pressure switch in accordance with the present invention.

Still with reference to FIG. 1, burner assembly 36 of gas furnace 30 includes a plurality of burners 50 which receive a combustible fluid to be burned, such as natural gas, through a gas manifold 51, which passes from gas valve 52 of furnace gas valve assembly 38. As seen in FIG. 2, an inlet gas supply line 60 passes into gas valve 52, which controls its passage outwardly of gas valve 52 into manifold 51, in a conventional manner. As is conventional in the art, a plurality of burners 50 are provided, one burner 50 being associated with each heat exchanger 44. A conventional pilot assembly 56 is provided, as will hereinafter be described in greater detail in connection with FIG. 2, and pilot assembly 56 serves to ignite the natural gas flowing from gas manifold 51 into burners 50, when it is desired to activate furnace 30 to provide heated air to the space, or room (not shown), to be heated.

With reference to FIG. 2, the pilot pressure switch 100 in accordance with the present invention will be described. As seen in FIG. 2, furnace gas valve 52 of furnace gas valve assembly 38 receives a combustible fluid, such as natural gas through a gas inlet 60, and furnace gas valve 52, which is of conventional construction, controls the passage of natural gas through furnace gas valve 52 to gas manifold 51 in a conventional manner. A conventional pilot line 65 is connected to furnace gas valve 52 and passes to the pilot assembly 56, pilot line 65 providing the necessary fluid, or natural gas, to be burned within pilot assembly 56. Pilot line 65 is of conventional construction, and is preferably made from aluminum tubing. Pilot assembly 56 is also of conventional construction and is intended to provide a continuously burning pilot flame 66. A conventional pilot thermocouple 67 is connected to furnace gas valve 52, and passes to pilot assembly 56 in a conventional manner.

Still with reference to FIG. 2, a conventional room thermostat is schematically shown at 70, thermostat 70 being of conventional construction and is disposed at a remote location from furnace 30, and typically has a plurality of wires passing from thermostat 70 to various elements of furnace 30, at least one wire 71 disposed between thermostat 70 and blower control 40. Wire 71 is commonly referred to as the "W", or heat, leg of the thermostat circuitry. If the temperature within the space, or room (not shown) to be heated falls below a predetermined temperature, thermostat 70 sends a electrical signal, or control voltage, along the at least one wire 71 to the blower control 40. Blower control 40 in turn sends a signal in a conventional manner to initiate operation of furnace vent blower 46, and after a check of the conventional furnace safety controls, burners 50 are ignited, and main furnace blower 48 is caused to operate by blower control 40. Blower control 40 may be of conventional construction, and is preferably a solid state blower control device, as are known in the art. If pilot flame 66 is not present, although it is intended that pilot flame 36 be continuously burning, or lit, the operation of furnace vent blower 46 and main furnace blower 48 (FIG. 1) will occur as previously described, unless furnace 30 is provided with the pilot pressure switch 100 of the present invention.

Pilot pressure switch 100 preferably includes a means for detecting 101 the fluid pressure within the pilot line 65, the fluid pressure detecting means 101 being disposed in fluid communication with pilot line 65; and a means for controlling 102 the passage of an electrical signal through the at least one wire 71 in response to the fluid pressure detected in the pilot line 65. Preferably, the means for detecting 101 the fluid pressure within pilot line 65 is a diaphragm switch 103 which is in fluid communication with pilot line 65 as by a small opening 104 disposed in pilot line 65. Preferably, the means for controlling 102 the passage of an electrical signal through the at least one wire 71 in response to fluid pressure within pilot line 65, is a single pole, single throw electrical switch 105 of conventional construction, and is operatively associated with the detecting means 101 or diaphragm switch 103. Diaphragm switch 103 and the single pole, single throw electrical switch 105 associated therewith, is of conventional construction and may be obtained from TriDelta Industries, Inc. of Mentor, Ohio. as Model No. BSGFF 3457.

The operation of pilot pressure switch 100 in connection with the operation of furnace 30 will now be described. Diaphragm switch 103 of the means for detecting 101 the fluid pressure in pilot line 65 continuously monitors the fluid pressure within pilot line 65, the natural gas therein being provided by furnace gas valve 52 in a conventional manner, as previously described. If the fluid, or gas pressure, within pilot line 65 exceeds a predetermined fluid, or gas, pressure, control means 102, or the single pole, single throw electrical switch 105, which may be normally open, is closed to permit an electrical signal, or control voltage, to pass from thermostat 70 through wire 71 to blower control 40, whereby furnace 30 may be operated in the manner previously described. The means for detecting 101, or diaphragm switch 103, operates switch 105, when it detects a predetermined fluid pressure which has a value indicative of enough gas, or combustible fluid, passing through pilot line 65 to pilot assembly 56, in order to maintain pilot flame 66 continuously burning, or lit. For example, the predetermined fluid, or gas, pressure detected by diaphragm switch 103 could be preset at approximately 4 inches WC (water column). If pilot thermocouple 67 becomes inoperable, or if there is not sufficient gas, or fluid, pressure within pilot line 65, which might result from an interruption in the supply of natural gas to furnace gas valve 52, or because of an obstruction or other defect within furnace gas valve 52 or pilot line 65, the fluid, or gas, pressure within pilot line 65 would drop below the predetermined fluid, or gas, pressure within pilot line 65. At such time, after this undesired, lower pressure level, such as below approximately 4 inches WC (water column) has been detected by diaphragm switch 103, single pole, single throw electrical switch 105 would be energized to return it to its normally open position, whereby an electrical signal from thermostat 70 could not pass through the at least one wire 71 to blower control 40. Thus, if pilot flame 66 is not lit, or burning, or if there is a defect in the pilot thermocouple 67, blower control 40 will not be operable to energize furnace vent blower 46 and main furnace blower 48.

It is to be understood that the invention is not limited to the exact details of construction, operation, exact materials or embodiment shown and described, as obvious modifications and equivalents will be apparent to one skilled in the art; for example, a switch, other than a diaphragm switch, could be used to detect the fluid pressure within the pilot line. Accordingly, the invention is therefore to be limited only by the scope of the appended claims.

We claim:

1. A pilot pressure switch for a furnace having a continuously burning pilot flame in fluid communication with a furnace gas valve by a pilot line disposed between the pilot flame and the gas valve, the furnace also including a thermostat and a blower control with at least one wire disposed between the thermostat and the blower control, comprising:

a means for detecting the fluid pressure within the pilot line, the fluid pressure detecting means being disposed in fluid communication with the pilot line; and a means for controlling the passage of an electrical signal through the at least one wire in response to the fluid pressure detected in the pilot line, whereby if the fluid pressure detected in the pilot line exceeds a predetermined fluid pressure, the electrical signal from the thermostat passes through the at least one wire to the blower control.

2. The pilot pressure switch of claim 1, wherein the means for detecting the fluid pressure is a diaphragm switch.

3. The pilot pressure switch of claim 1, wherein the means for controlling the passage of the electrical signal is a single pole, single throw electrical switch which is operatively associated with the means for detecting the fluid pressure.

4. The pilot pressure switch of claim 2, wherein the means for controlling the passage of the electrical signal is a single pole, single throw electrical switch which is operatively associated with the diaphragm switch.

5. A method for controlling the operation of a furnace having a continuously burning pilot flame in fluid communication with a furnace gas valve by a pilot line disposed between the pilot flame and the gas valve, the furnace also including a thermostat and a blower control with at least one wire disposed between the thermostat and the blower control, comprising the steps of:

detecting the fluid pressure within the pilot line;

controlling the passage of an electrical signal through the at least one wire in response to the fluid pressure in the pilot line; and permitting the electrical signal to pass through the at least one wire from the thermostat to the blower control when the fluid pressure detected in the pilot line exceeds a predetermined fluid pressure.

6. The method of claim 5, including the step of not permitting the electrical signal to pass through the at least one wire from the thermostat to the blower control when the fluid pressure detected in the pilot line is less than the predetermined fluid pressure.

7. The method of claim 5, including the step of utilizing a diaphragm switch disposed in fluid communication with the pilot line to detect the fluid pressure in the pilot line.

8. The method of claim 5, including the step of utilizing a single pole, single throw electrical switch to control the passage of the electrical signal through the at least one wire.

9. The method of claim 8, including the step of closing the single pole, single throw electrical switch to permit the electrical signal to pass through the at least one wire, when the fluid pressure detected in the pilot line exceeds the predetermined fluid pressure.

* * * * *